US005856724A

United States Patent [19]

Chiu et al.

[11] Patent Number: 5,856,724

[45] Date of Patent: Jan. 5, 1999

[54] HIGH EFFICIENCY, EXTENDED LIFE SPARK PLUG HAVING SHAPED FIRING TIPS

[75] Inventors: Randolph Kwok-Kin Chiu; Keith Allen Penney; Donald Robert Van Uum, all of Davidson, Mich.; William Thomas Phillips, Jr., Boardman, Ohio

[73] Assignee: General Motors Corporation, Detroit, Mich.

[21] Appl. No.: 193,982

[22] Filed: Feb. 8, 1994

[51] Int. Cl.[6] ..... H01T 13/20

[52] U.S. Cl. ..... 313/141

[58] Field of Search ..... 313/141

[56] References Cited

U.S. PATENT DOCUMENTS

| | | | |
|---|---|---|---|
| 2,946,912 | 7/1960 | Christenson | 313/141 |
| 3,673,452 | 6/1972 | Brennen | 313/141 |
| 4,540,910 | 9/1985 | Kondo et al. | 313/141 |
| 4,700,103 | 10/1987 | Yamaguchi et al. | 313/141 |
| 5,196,760 | 3/1993 | Takamura et al. | 313/142 |
| 5,273,474 | 12/1993 | Oshima et al. | 313/141 |

FOREIGN PATENT DOCUMENTS

| | | |
|---|---|---|
| 3-98279 | 4/1991 | Japan . |

*Primary Examiner*—Vip Patel
*Attorney, Agent, or Firm*—Charles K. Veenstra

[57] ABSTRACT

A spark plug is provided which is suitable for use in a spark ignition system for an internal combustion engine. The spark plug is equipped with a specially configured firing tip on each of its electrodes for the purpose of minimizing the demand voltage of the spark plug, as well as extending the life of the spark plug by maximizing the time over which the demand voltage will remain within an acceptable level. For this purpose, the firing tips are configured such that their firing surfaces include at least three edges and three corners which serve as arc initiation sites of a relatively low resistance arc path between the electrodes.

6 Claims, 3 Drawing Sheets

HIGH EFFICIENCY, EXTENDED LIFE SPARK PLUG HAVING SHAPED FIRING TIPS

The present invention generally relates to a spark plug of the type used in an electric spark ignition system of an internal combustion engine, in which noble metal firing tips are attached to the electrodes of the spark plug for the purpose of extending the service life of the spark plug. In particular, this invention relates to a method for forming the noble metal firing tips of such a spark plug, so as to provide multiple edges and corners for the purpose of reducing the demand voltage and heat losses, while further extending the service life of the spark plug. Lower demand voltages made possible by this invention enable easier sparking across the spark gap of a fouled spark plug, such that cold start and engine performance is improved.

BACKGROUND OF THE INVENTION

Spark ignition of an internal combustion engine generally involves igniting an air/fuel mixture with an electric spark generated between a center electrode and a ground electrode of a spark plug. The facing surfaces of the center and ground electrodes are typically flat, and serve as arcing or firing surfaces between which the electric spark is generated. The voltage required to generate a spark between the electrodes is often referred to as the sparking, arcing, or demand voltage, and is known to be dependant in part on the spark gap between the electrodes and the size of the electrodes. Typically, the electrodes are formed from a nickel-based alloy which is resistant to the harsh electrical, thermal, chemical and mechanical environment of an engine's combustion chamber. The nickel-based alloy is often applied over a copper core which improves the thermal conductivity of the electrodes, such that excessive electrode temperatures are avoided that might otherwise cause auto-ignition.

As illustrated by U.S. Pat. No. 5,196,760 to Takamura et al., electrodes which are specially shaped to maintain the demand voltage at a relatively constant level over the life of the spark plug are known. Takamura et al. teach a center electrode having an annular undercut. The thickness of the portion above the undercut determines the useful life of the spark plug, in that the demand voltage remains generally stable while this portion exists, but increases drastically once the electrode has eroded down to the undercut. The portion of the electrode above the undercut has a circular cross-section, as is conventional, such that the circular perimeter of the electrode's firing surface provides a single and continuous sharp edge as an arc initiation site for an electric spark. However, as noted by Takamura et al., this edge is eventually consumed, such that suitable arc initiation sites available during the majority of the spark plug's life are limited to the electrode's firing surface and the sharp edge formed by the undercut and the portion remaining above the undercut.

As noted in Takamura et al., it is known to substitute a noble metal for the more conventional nickel alloys for the purpose of extending the life of the electrode. The use of a noble metal electrode is particularly advantageous when attempting to minimize the size of the electrode. As is known in the prior art, minimizing the size of an electrode reduces the potential for a phenomenon known as flame quenching or extinguishing, which occurs when an excessive amount of thermal energy in the flame kernel produced within the spark gap is absorbed by the electrode. As is also known in the prior art, a smaller electrode also serves to lower the demand voltage of its spark plug.

To minimize the amount of noble metal required, it is also known to attach a noble metal firing tip, such as a thin platinum alloy disc, to the firing surface of an otherwise conventional nickel alloy electrode, for the purpose of minimizing the amount of noble metal required. U.S. Pat. No. 4,700,103 to Yamaguchi et al. teaches a variation of this, in which a firing tip having minimal mass is welded to and projects from the surface of its base electrode. As a result, the firing tip is specifically configured to benefit from the advantages noted above with smaller electrodes. The firing tip taught by Yamaguchi et al. preferably has a rectangular shape with a square cross-section, with its longitudinal axis being oriented transverse to the axis of the center electrode. The firing tip is not coaxially aligned with the center electrode, as is conventionally done, but is offset such that only an edge of the firing tip is proximate to the center electrode. Alternative shapes are suggested for the firing tip, including circular, trapezoidal, and triangular cross-sections.

While the above approaches taught by the prior art generally achieve their respective objectives, further improvements in efficiency would be desirable. For example, though the demand voltage for the spark plug taught by Takamura et al. remains generally stable as long as the portion above the undercut is present, the demand voltage nevertheless increases significantly as the sharp edge at the firing surface's perimeter is eroded. While the noble metal firing tip taught by Yamaguchi et al. offers advantages over the electrode taught by Takamura et al., the potential arc initiation sites on the firing tip are generally limited to the proximate edge and its included corners. Consequently, as the spark gap increases with the consumption of the edge and its corners during the life of the spark plug, a corresponding and immediate increase in the demand voltage also occurs.

Therefore, it would be desirable if the advantages of a noble metal firing tip could be realized, in which the firing tip is specifically configured so as to achieve and maintain a relatively stable demand voltage over a longer period of time so as to further extend the service life of the spark plug. Such a firing tip would be even more desirable if an actual reduction in demand voltage could be achieved for a given spark gap. Finally, the firing tip would also preferably contribute minimal mass to a spark plug electrode so as to minimize the potential for flame quenching. A suitable method for forming such a firing tip would also be desirable in order to adapt the firing tip to mass production conditions.

The prior art spark plug 110 illustrated in FIGS. 1 and 2*a*–2*g* is representative of that taught by U.S. Pat. No. 4,700,103 to Yamaguchi et al. As is conventional, the spark plug 110 includes a ceramic body 112 which serves as an insulator between a center electrode 114 and a ground electrode 116. A first firing tip 118 is welded to the upper surface of the center electrode 114, while a second firing tip 120 is welded to the lower surface of the ground electrode 116. Both firing tips 118 and 120 are preferably formed from a noble metal, such as a platinum alloy. As can be seen in FIG. 1, the distal end 116*a* of the ground electrode 116 terminates short of the axis of the center electrode 114. The firing tip 120 projects from the distal end 116*a* of the ground electrode 116, such that an edge and two corresponding corners of the firing tip 120 are proximate the firing surface 118*a* of the firing tip 118. As such, the edge and corners serve as the firing "surface" 120*a* of the ground electrode 116, in that they represent arc initiation sites for the lowest resistance arcing path of an electric spark generated between the electrodes 114 and 116. As illustrated in FIG. 2*a*, the cross-section of the firing tip 120 shown in FIG. 1 is square, with the firing tip 120 being secured in a recess within the ground electrode 116. FIGS. 2*b* through 2*g* illustrate variations taught by Yamaguchi et al., in which the cross-section of the firing tip 120 is altered or the degree to which the firing tip 120 is recessed into the ground electrode 116 is altered.

While Yamaguchi et al. generally teach the advantages of spark plugs equipped with noble metal firing tips, a significant shortcoming of the spark plug 110 is that the firing surface 120*a* is not a surface at all, but only two corners of the firing tip 120 and their included edge. As such, the demand voltage for the spark plug 110 will increase significantly as the edge and corners erode, in that (1) the rate of erosion along the edge will be relatively high due to the spark being concentrated at a single edge, and (2) the spark gap between the firing tips 118 and 120 will increase as the firing surface 120*a* erodes. The alternative embodiments illustrated in FIGS. 2*b* through 2*g* provide, most preferably, two corners and one edge as arc initiation sites (FIGS. 2*a*, 2*e* and 2*g*) and, as a lesser preferred alternative, only one edge as an arc initiation site (FIG. 2*c*). Though three edges are present with the trapezoidal cross-section shown in FIG. 2*e*, the oblique edges are not preferential arc initiation sites due to their relative distance from the firing surface 118*a* on the center electrode 114. A further disadvantage with each of the configurations shown in FIGS. 2*a* through 2*g* is that, by locating the firing tip 120 within a recess in the ground electrode 116, the center and ground electrodes 114 and 116 are positioned closer together, thus increasing the potential for flame quenching.

SUMMARY OF THE INVENTION

It is an object of this invention to provide a firing tip for each of a pair of electrodes of a spark plug, in which the firing tips are configured to minimize the demand voltage of the spark plug.

It is another object of this invention that such a firing tip have a firing surface characterized by multiple arc initiation sites from which an electric spark can occur, so as to extend the life of the spark plug by maximizing the time over which the demand voltage will remain within an acceptable level.

It is yet another object of this invention that such a firing tip be formed from a noble metal so as to further extend the service life of the spark plug.

It is a further object of this invention to provide a method for forming such a firing tip, such that the firing tip can be readily formed and attached to an electrode in a manner that is compatible with mass production methods.

In accordance with a preferred embodiment of this invention, these and other objects and advantages are accomplished as follows.

According to the present invention, there is provided a spark plug which is suitable for use in a spark ignition system for an internal combustion engine. The spark plug is equipped with a specially configured firing tip on each of its electrodes for the purpose of minimizing the demand voltage of the spark plug, as well as extending the life of the spark plug by maximizing the time over which the demand voltage will remain within an acceptable level. For this purpose, the firing tips are configured such that their firing surfaces include multiple arc initiation sites.

In accordance with this invention, it has been determined that the presence of an edge or corner on the firing surface of an electrode serves to lower the demand voltage of the spark plug by furnishing a relatively low resistance arc path between the electrodes. Furthermore, multiple edges and corners provide multiple arc initiation sites, which enable the demand voltage to remain more constant over the life of the spark plug in that, as each edge or corner becomes eroded, resulting in an increase in demand voltage, a substantially unworn initiation site will yet be available at which a spark can be generated at a lower demand voltage.

The spark plug of this invention generally includes a pair of electrodes which define a spark gap across which an electric spark can be generated for igniting a fuel mixture within the combustion chamber of an internal combustion engine. Mounted to each of the electrodes is a firing tip, such that the firing tips are substantially coaxially aligned. The pair of firing tips are preferably formed to be substantially smaller than the electrodes for the purpose of reducing heat loss to the electrodes, while also serving to reduce the demand voltage because of their smaller diameter. As such, it is preferable to form the firing tips from a noble metal alloy, such as the erosion resistant and lead resistant platinum alloy Pt-10Pd-6Ru, to promote the ability of the firing tips to reduce erosion during operation. The electrodes are preferably formed from an electrically conductive material having a coefficient of thermal expansion approximately equal to that of the noble metal alloy from which the firing tips are formed, so as to promote the integrity of the bond between the firing tips and their electrodes.

In accordance with a preferred aspect of this invention, each firing tip is shaped so as to define at least three edges and at least three corners within its firing surface which serve as potential arc initiation sites for generating an electric spark across the spark gap. Most preferably, the cross-sectional shape of the firing tips is either a square, a rhombus, or a triangle, though other polygonal shapes are also suitable. The minimum three edges and corners furnished by each of the firing tips provide multiple arc initiation sites which serve to achieve and maintain a minimal sparking voltage for the spark plug.

In accordance with a method of this invention, the firing tips are butt welded to their respective electrodes. The method can be carried out using several alternative approaches. A first method involves welding a wire to each electrode, and then cutting and forming each wire to produce firing tips having the desired cross-sectional shape. With this approach, when welded to the electrode, the wire can have a round cross-section prior to the forming operation. A second method involves preforming the wire to have the desired cross-sectional shape prior to the welding operation. After welding and cutting, the firing tip is coined so as to achieve a more uniform shape with a substantially planar firing surface. A third method involves cutting the firing tips from a flat metal ribbon, such that the firing tips are in the form of relatively thin discs having the desired cross-sectional shape. The firing tips are then individually welded to their respective electrodes. With this method, a final coining operation is unnecessary.

From the above, it can be seen that each of the above methods enables the manufacture of a spark plug having the advantageous firing tip configuration of this invention. As a result, spark plugs which exhibit a relatively low and constant demand voltage can be readily mass produced for the automotive industry. Operational benefits attributable to a relatively low and constant demand voltage include an extended stable operating regime for the engine, such as at idle and at cold start, the ability for the engine to operate at a leaner air/fuel ratio, and lower engine exhaust emissions. Furthermore, because the firing tips are sized to contribute minimal mass to the electrodes, thermal losses to the electrodes are minimized, so as to reduce the potential for flame quenching.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings wherein.

DETAILED DESCRIPTION OF THE INVENTION

Figure 3:
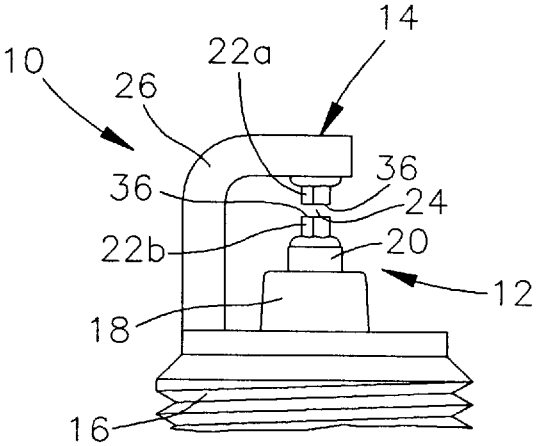
FIG. 3 shows a side view of a spark plug in accordance with a preferred embodiment of this invention.

The present invention provides a spark plug which is adapted for use in a spark ignition system of an internal combustion engine. As shown in FIG. 3, and similar to spark plugs of this type known in the prior art, the spark plug 10 formed in accordance with this invention includes a pair of electrodes 20 and 26 across which an electric spark is generated for igniting an air/fuel mixture within a combustion chamber of the engine.

Figure 1:
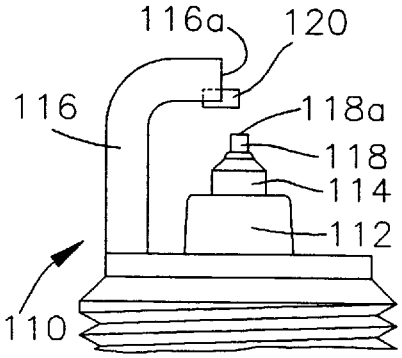
FIG. 1 PRIOR ART
FIG. 1 shows a side view of a spark plug as taught by the prior art, in which a noble metal firing tip is welded to both the center and ground electrodes of the spark plug.
Figure 2A:
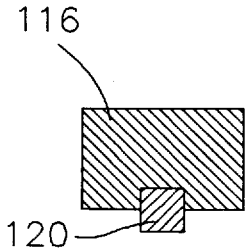
FIG. 2a PRIOR ART
FIGS. 2*a* through 2*g* are alternative cross-sectional views of the ground electrode of FIG. 1.
Figure 2B:
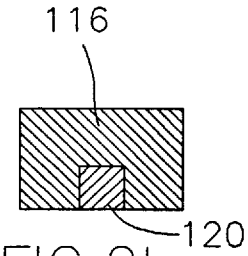
FIG. 2b PRIOR ART
Figure 2C:
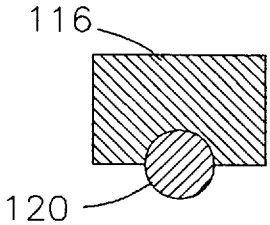
FIG. 2c PRIOR ART
Figure 2D:
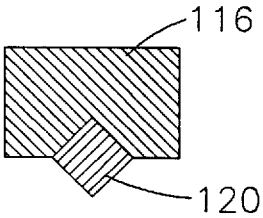
FIG. 2d PRIOR ART
Figure 2E:
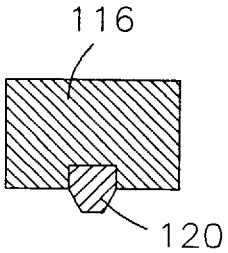
FIG. 2e PRIOR ART
Figure 2F:
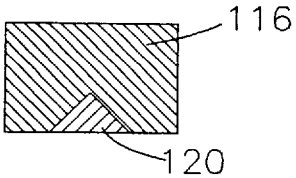
FIG. 2f PRIOR ART
Figure 2G:
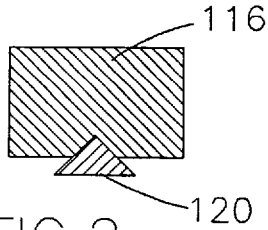
FIG. 2g PRIOR ART

Furthermore, the electrodes 20 and 26 are equipped with noble metal firing tips 22*a* and 22*b* which define firing surfaces 36 for the electrodes 20 and 26. While firing tips formed from a noble metal are known in the prior art, as evidenced by the prior art represented in FIGS. 1 and 2, the firing tips 22*a* and 22*b* of this invention are specifically configured to reduce the demand voltage associated with the spark plug 10, while also maintaining the demand voltage at a suitable level over a longer period of operation.

In contrast to the prior art represented in FIGS. 1 and 2*a* through 2*g*, the spark plug 10 of this invention provides multiple arc initiation sites composed of at least three edges and at least three corners, as shown in FIGS. 3 and 4*a* through 4*e*. With reference to FIG. 3, the spark plug 10 is generally conventional in its construction, in that it includes a steel shell 16 which houses an insulator body 18. The insulator body 18 electrically isolates a center terminal 12 from a ground terminal 14. The center terminal 12 includes the center electrode 20 which is disposed within a passage in the insulator body 18, while the ground terminal 14 includes an L-shaped ground electrode 26 which is welded to the shell 16.

The noble metal from which the firing tips 22*a* and 22*b* are formed is preferably a lead resistant platinum alloy, such as Pt-10Pd-6Ru, although other suitable alloys such as Pt—Ir, Pt—Ni, Pt—Ru and Pt—Pd could also be used, as well as others. The center and ground electrodes 20 and 26 are preferably formed from a suitable alloy having a thermal coefficient of expansion which is approximately equal to that of the noble metal from which the firing tips 22*a* and 22*b* are formed. For example, the center electrode 20 is preferably formed from a copper-cored Inconel 600 material, while the ground electrode 26 is preferably formed from Inconel 600 or an Fe-15Cr-4Al alloy. The firing tips 22*a* and 22*b*, are not secured within recesses formed in the electrodes 20 and 26, but instead are butt welded directly to the surfaces of the electrodes 20 and 26, respectively. The firing tips 22*a* and 22*b* preferably have a cross-sectional area of about 0.35 to about 0.85 square millimeter and a length of between about 0.2 and about 1.5 millimeters, depending on the manner in which the firing tips 22*a* and 22*b* are formed. However these dimensions may vary greatly depending on the particular application.

In accordance with a preferred aspect of this invention, the pair of firing tips 22*a* and 22*b* are oriented and configured in a manner markedly different from that of the prior art. As shown, the firing tips 22*a* and 22*b* are coaxially aligned between the center and ground electrodes 20 and 26, with each having a firing surface 36 which is substantially parallel to that of the other. Furthermore, in accordance with a preferred embodiment of this invention, the firing tips 22*a* and 22*b* have a substantially square cross-section, as indicated in FIG. 3 and as shown in greater detail in FIG. 4*a*. As such, each of the firing surfaces 36 is composed of four sharp edges and four sharp corners, any of which may serve as an arc initiation site at any given instant. Accordingly, an electric spark generated between the center and ground electrodes 20 and 26 will occur at one of these arc initiation sites in preference to the planar inner regions of the firing surfaces 36 due to the edges and corners offering lower resistance arcing paths for the spark. Consequently, the demand voltage associated with these arc initiation sites will be significantly less than would be achieved if initiated within the planar inner regions of the firing surfaces 36. It is this lower demand voltage that facilitates firing across the spark gap of a fouled spark plug and thereby improves cold start and engine performance.

Figure 4A:
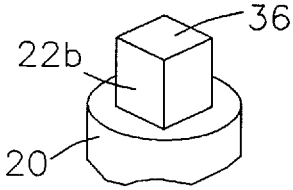
FIGS. 4*a* through 4*h* are side views of the center electrode of FIG. 3 in accordance with alternative embodiments of this invention.
Figure 4B:
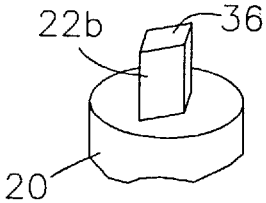
Figure 4C:
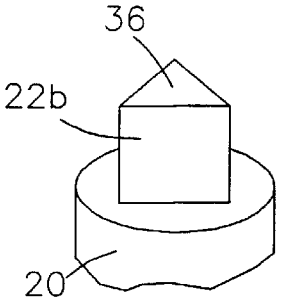
Figure 4D:
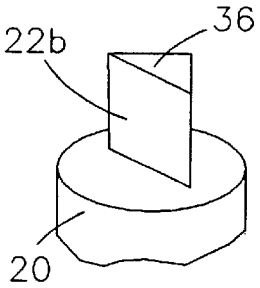
Figure 4E:
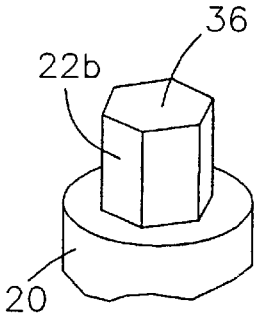
Figure 4F:
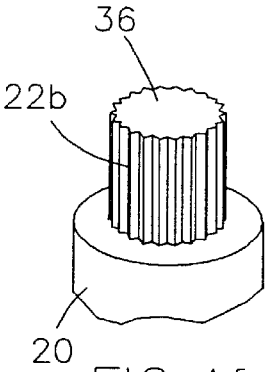
Figure 4G:
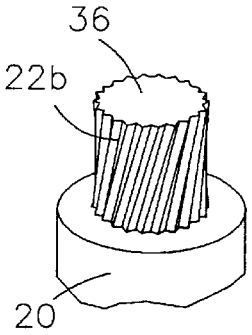
Figure 4H:
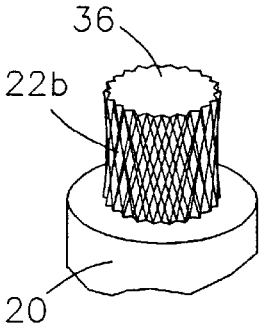

Additional configurations for the firing tips 22*a* and 22*b* are illustrated in FIGS. 4*b* through 4*e*. FIG. 4*b* illustrates the firing tip 22*b* having a rhomboid cross-section such that its firing surface 36 is again composed of four edges and four corners. FIGS. 4*c* and 4*d* illustrate the firing tip 22*b* having equilateral and isosceles triangular cross-sections, such that their firing surfaces 36 are composed of three edges and three corners. FIG. 4*e* illustrates a polygonal cross-section such that its firing surface 36 is composed of at least five edges and five corners.

With each embodiment illustrated in FIGS. 4*a* through 4*e*, the firing tip 22*b* has been specifically shaped so as to create at least three edges and at least three corners, with the sharpness of the edges and corners having a direct and beneficial impact on the demand voltage for the spark plug 10. In particular, it is believed that the presence of sharp corners at the perimeter of a firing surface 36 is a primary condition for achieving a low demand voltage. It is further believed that the acute corners of the rhomboid and isosceles triangular cross-sections (FIGS. 4*b* and 4*d*) are particularly capable of reducing the demand voltage as compared to their square (4*a*) and equilateral (4*c*) counterparts.

Figure 8A:
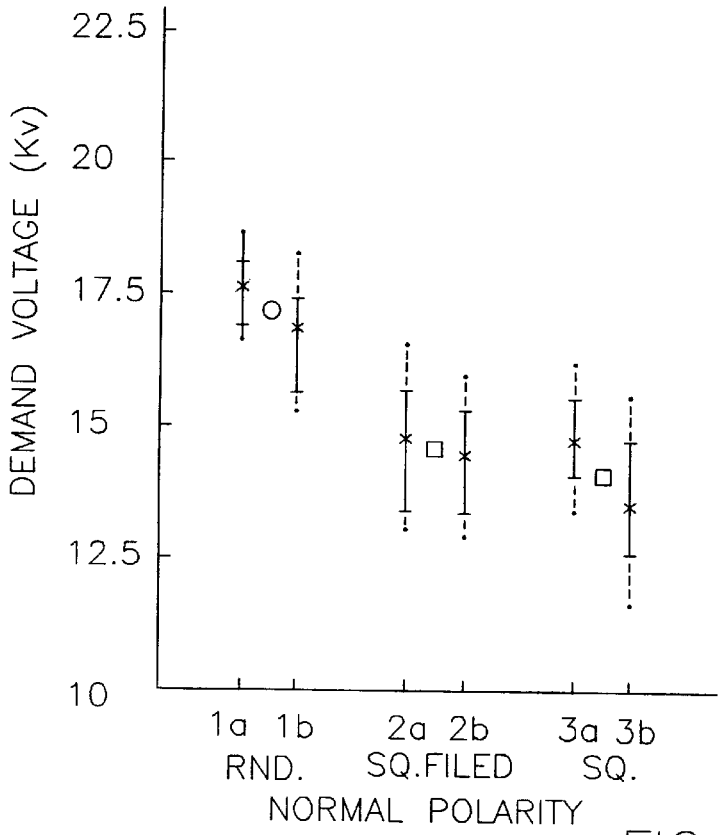
FIGS. 8*a* and 8*b* are graphs which illustrate the degree to which demand voltage can be reduced in accordance with the preferred embodiment of this invention.
Figure 8B:
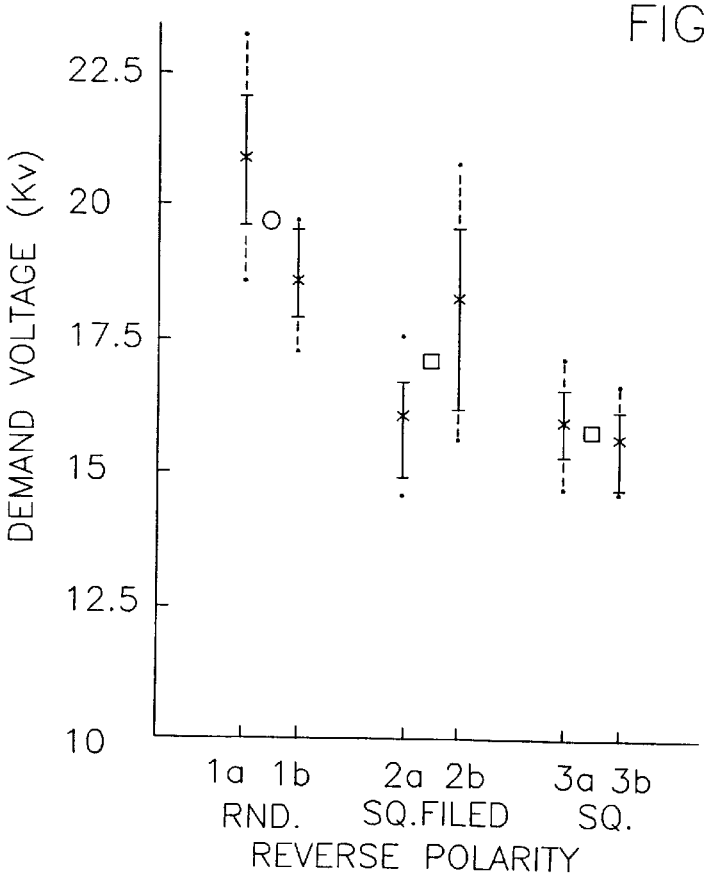

FIGS. 8*a* and 8*b* represent the effect that the square-shaped firing tip 22*a* and 22*b* shown in FIG. 3 has on the demand voltage of a spark plug, in comparison to a conventional round firing tip. The demand voltage will depend in part on the polarity of the electrodes, with the demand voltage under normal polarity (where the center electrode 20 is charged positive and the ground electrode 26 is charged negative) and reverse polarity being represented. Each of the firing tips tested was formed from the preferred Pt-10Pd-6Ru alloy. "Round" denotes a firing tip having a circular diameter of about 1.00 millimeter and a height of about 1.00 millimeter. The firing tips denoted as "Square" each had a square cross-section with a width of about 0.80 millimeter and a height of about 1.00 millimeter. "Square, Filed" indicates that the firing tip had been filed such that its firing surface 36 was flat and substantially parallel to its opposing firing tip. Omission of the "Filed" notation indicates that the firing tip had surface irregularities due to the forming and joining process by which the firing tip was attached to its electrode. The spark gap was set at about 1.50 millimeters, and the test pressure was about 75 psig.

FIGS. 8*a* and 8*b* illustrate that an average reduction in demand voltage of about 2.5 to about 4 kV was achieved for the square-shaped firing tips 22*a* and 22*b* as compared to the round firing tips tested. The results demonstrated that an electric spark generated between the center and ground electrodes 20 and 26 occurred at one of the arc initiation sites present on the square-shaped firing tips 22*a* and 22*b* in preference to the planar inner regions of the firing surfaces 36 due to the edges and corners offering lower resistance arcing paths for the spark. Consequently, the demand voltages for the square-shaped firing tips 22*a* and 22*b* were significantly less than could be achieved if initiated within the planar inner regions of the firing surfaces 36.

From the results of the data represented in FIGS. 8*a* and 8*b*, it was concluded that the basis for the reduction in demand voltage seen was the presence of the sharp edges and corners at the perimeter of the firing surfaces 36 of the square-shaped firing tips 22*a* and 22*b*. In particular, the edges and corners of the firing tips 22*a* and 23*b* of this invention are more prominent than the edge of a round firing tip, so as to apparently offer a lower resistance arcing path as compared to the single edge of the round firing tip. Furthermore, because the firing tips 22*a* and 22*b* of this invention consisted of four edges and four corners, the firing tips 22*a* and 22*b* would be capable of maintaining the demand voltage at a relatively low level over a relatively long duration. For example, during firing, an electric arc will occur between a corner on the firing surface 36 of the center electrode 20 and a corner on the firing surface 36 of the ground electrode 26. These corners will each gradually erode during operation. However, as these corners erode, additional corners and edges will be available as arc initiation sites which offer a lower arcing resistance than the worn corners due to a shorter gap therebetween. Consequently, two opposing edges or corners will take over and initiate arcing in such a way that an electric spark will always occur across the sharpest pair of corner or edges, resulting in a minimum demand voltage.

From the above, it can be appreciated that two distinct attributes have been identified through this invention by which the firing tips 22*a* and 22*b* can be configured to exhibit improved performance in comparison to firing tips of the prior art. First, the firing surfaces 36 of the firing tips 22*a* and 22*b* are formed to have sharp edges and corners which are physically prominent and therefore offer relatively low resistance arc paths between opposing electrodes 20 and 26. Thus, the sharp edges and corners serve as preferential arc initiation sites on the firing surfaces 36, so as to result in a lower demand voltage. Secondly, the firing tips 22*a* and 22*b* are configured to include a number of potential arc initiation sites in order to effectively maintain the demand voltage at the lower level over a longer period of operation. The preferred physical configurations for the firing tips 22*a* and 22*b* shown in FIGS. 4*a* through 4*e* can be achieved by utilizing one of several methods that are suitable for use in mass production. The methods are summarized in FIGS. 5 through 7.

Figure 5A:
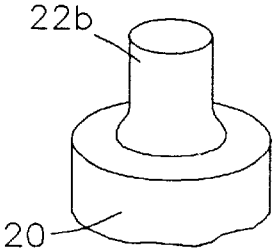
FIGS. 5*a* through 5*c* illustrate a first method by which a firing tip of this invention can be formed.
Figure 5B:
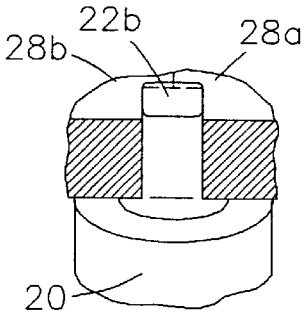
Figure 5C:
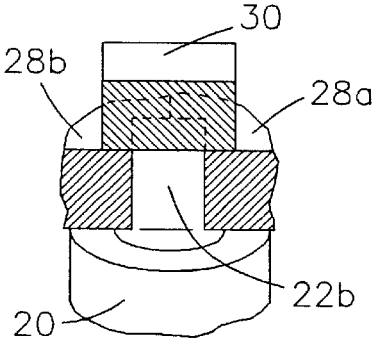

FIGS. 5*a* through 5*c* illustrate a first method by which the firing tips 22*a* and 22*b* of this invention can be formed. This method involves the use of a round wire formed from a suitable noble metal alloy, such as the preferred Pt-10Pd-6Ru alloy. As illustrated in FIG. 5*a*, round wire having a diameter of about 0.70 to about 1.0 millimeter can be fed directly to one of the electrodes, here the center electrode 20. The wire is then butt welded to the electrode 20 in any suitable manner, such as by laser, electron beam, or resistance welding. In a preferred embodiment, a vertical feed resistance welder is used, with the wire being held in place during the welding operation with a collect. After welding, the wire is cut to an appropriate length, and a pair of die halves 28*a* and 28*b* are brought in to engage and deform the perimeter of the round wire and thereby impart the desired cross-sectional shape of the firing tip 22*a* and 22*b*, such as the square cross-sectional shape shown in FIG. 5*b*. Finally, a coining tool 30 is used to impact the cut surface of the wire, so as to define the firing surface 36 of the firing tip 22*a* and 22*b*. The resulting firing tip 22*a* and 22*b* preferably has a cross-sectional area of about 0.35 to about 0.85 square millimeter, an axial height (length) of about 0.70 to about 1.50 millimeters, and a mass of about 4 to about 25 milligrams. However, it is to be noted that these dimensions may vary greatly depending on the particular application.

Figure 6:
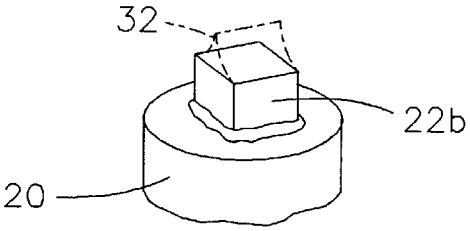
FIGS. 6 and 7 illustrate alternative methods by which firing tips of this invention can be formed.

As an alternative to the method illustrated in FIG. 5, FIG. 6 illustrates a second method by which the firing tips 22*a* and 22*b* of this invention can be formed from a noble metal wire. This method differs from the first method, in that it utilizes a wire having a cross-sectional shape which is substantially that of the desired final cross-sectional shape of the firing tip 22*a* and 22*b*. The wire is formed from a suitable noble metal alloy, such as the preferred Pt-10Pd-6Ru alloy, and has a square width of about 0.60 to about 0.90 millimeter. As before, the wire is preferably fed directly to one of the electrodes with a vertical feed resistance welder, with the wire being held in place during the welding operation with a collect. After welding, the wire is cut to an appropriate length, and then coined so as to minimize the presence of surface irregularities on the firing surface 36, such as an apex 32 formed by the cutting operation, shown in phantom in FIG. 6. As before, the resultant firing tip 22*a* and 22*b* will preferably have a cross-sectional area of about 0.35 to about 0.85 square millimeter, a length of about 0.70 to about 1.50 millimeters, and a mass of about 4 to about 25 milligrams. However, it is to be noted that the teachings of this invention are not to be limited to the dimensions stated above, in that any of these dimensions may vary, depending on the particular application.

Figure 7:
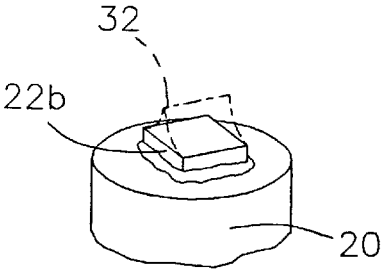

Finally, FIG. 7 illustrates a third variation for the firing tips 22*a* and 22*b* of this invention. This embodiment involves forming the firing tips 22*a* and 22*b* as thin discs from the preshaped wire utilized in the second method corresponding to FIG. 6, with only the thickness of the firing tips 22*a* and 22*b* serving to distinguish the firing tips 22*a* and 22*b* from those formed by the second method. After a coining operation, the resulting firing tips 22*a* and 22*b* preferably have a cross-sectional area of about 0.35 to about 0.85 square millimeter, an axial height (thickness) of about 0.20 to about 0.50 millimeter, and a mass of about 3 to about 8 milligrams. Alternatively, the disc-shaped firing tips 22*a* and 22*b* of this embodiment can be formed from a flat ribbon of a suitable noble metal, such that each firing tip 22*a* and

22*b* is essentially a thin disc having a peripheral shape in accordance with this invention. According to this method, the discs are cut from the flat ribbon by any suitable means, and then welded to their respective electrodes 20 and 26 using resistance spot, laser beam, electron beam or ultrasonic welding techniques. Advantageously, the coining operation noted with the previous processing methods is eliminated by this technique. The resulting firing tips 22*a* and 22*b* again preferably have a cross-sectional area of about 0.35 to about 0.85 square millimeter, an axial height (thickness) of about 0.20 to about 0.50 millimeter, and a mass of about 3 to about 8 milligrams.

From the above, it can be seen that a primary feature of the spark plug 10 formed in accordance with this invention, is that the spark plug 10 is characterized by a lower demand voltage which is sustained over a greater period of time than that made possible by prior art spark plugs. The lower demand voltage is achieved by providing sharp edges and corners on the firing surface 36 of firing tips 22*a* and 22*b* welded to the spark plug electrodes 20 and 26. In particular, it is believed that the presence of the sharp corners is a primary contributor to the low demand voltage exhibited by the spark plug 10 of this invention. By achieving a lower demand voltage, improved engine performance can be achieved, particularly at cold start and during engine idle. Other potential performance-related advantages include reduced heat loss to the electrodes 20 and 26, an extended stable operating regime of the engine, the ability to operate at leaner air/fuel ratios, and lower engine exhaust emissions.

The ability to sustain the lower demand voltage over a greater period of time is made possible by providing a relatively large number of corners and edges at the firing surface 36. Though a conventional round firing tip provides a sharp continuous edge along its perimeter, its edge will erode to a smooth rounded surface during use, thereby significantly increasing the demand voltage across the spark gap. However, in accordance with this invention, the shaped firing tips 22*a* and 22*b* have at least three sharp corners and at least three sharp edges. During engine operation, arcing will occur at an edge or corner of each opposed pair of firing tips 22*a* and 22*b*. The initial demand voltage will be lower than that for a round firing tip as a result of the lower resistance arcing path associated with the corners on the firing surface 36. As erosion occurs, additional sharp edges and corners will remain in order to maintain the demand voltage at a lower level, thus improving engine performance over a significant period of time. Forming the firing tips 22*a* and 22*b* from a noble metal, such as the preferred platinum alloy, further improves the life of the firing tips 22*a* and 22*b*, which are preferably small in order to reduce the potential for flame quenching as well as to reduce the demand voltage of the spark plug 10.

While our invention has been described in terms of a preferred embodiment, it is apparent that other forms could be adopted by one skilled in the art—for example, by substituting appropriate materials or modifying the geometry or construction of the components with which this invention is carried out. Accordingly, the scope of our invention is to be limited only by the following claims.

The embodiments of the invention in which an exclusive property or privilege is claimed are defined as follows:

1. A spark plug for igniting a fuel mixture within a combustion chamber of an internal combustion engine, the spark plug comprising:

a pair of electrodes which define a spark gap across which an electric spark is generated for igniting said fuel mixture; and a pair of firing tips affixed to said pair of electrodes such that said firing tips are coaxially aligned, said pair of firing tips being formed from a noble metal alloy, each of said pair of firing tips having a firing surface with a shape comprising at least three edges and at least three corners which form a convex polygon and serve as potential arc initiation sites for said electric spark across said spark gap;

whereby said at least three edges and said at least three corners of said pair of firing tips serve to minimize the sparking voltage for the spark plug.

2. A spark plug as recited in claim 1 wherein said firing surface shape is selected from the group consisting of a square, a rhombus, and a triangle.

3. A spark plug as recited in claim 1 wherein each firing surface has an area of about 0.35 to about 0.85 square millimeter.

4. A spark plug as recited in claim 1 wherein said pair of firing tips are affixed to said pair of electrodes with a weld.

5. A spark plug as recited in claim 1 wherein each of said pair of electrodes is formed from an electrically conductive material having a coefficient of thermal expansion approximately similar to said noble metal alloy.

6. A spark plug as recited in claim 1 wherein said noble metal alloy is a lead resistant platinum alloy containing palladium and ruthenium.

* * * * *